United States Patent [19]

Dively et al.

[11] 4,071,098

[45] Jan. 31, 1978

[54] CUTTER MOUNTING EXTENSION APPARATUS

[75] Inventors: Charles R. Dively; R. Kenneth Peterson, both of Seattle, Wash.

[73] Assignee: Ingersoll-Rand Company, Woodcliff Lake, N.J.

[21] Appl. No.: 736,521

[22] Filed: Oct. 28, 1976

[51] Int. Cl.[2] ..... E21B 9/26; E21C 13/12; E21C 23/00

[52] U.S. Cl. ..... 175/53; 175/263; 175/384

[58] Field of Search ..... 175/384, 382, 53, 266, 175/285, 263

[56] References Cited

U.S. PATENT DOCUMENTS

| | | | |
|---|---|---|---|
| 1,317,192 | 9/1919 | Jones | 175/384 X |
| 1,498,463 | 6/1924 | McCloskey et al. | 175/285 |
| 2,745,650 | 5/1956 | Smith | 175/285 X |
| 2,847,189 | 8/1958 | Shook | 175/384 X |
| 3,344,871 | 10/1967 | Goodman | 175/285 X |

*Primary Examiner*—Stephen J. Novosad

*Attorney, Agent, or Firm*—Bernard J. Murphy

[57] ABSTRACT

The apparatus comprises means for replaceable coupling thereof to a standard raise boring head for extending the effective cutting radius of the head. The apparatus comprises a raise boring head radius extension element which is pinned to struts extending from a circular hub; the hub, in turn, envelops a terminal end of the stem of the raise boring head. Additionally, pin-holed clevises borne by the extension elements mate with like pin-holed lugs which extend, radially, from the principal cutter bracket mounting platform of the standard raise boring head. Expansion pins are engaged with the lugs and clevises, and also secure the struts both to the hub and to the extension element, to simplify assembly and disassembly. In typical use, a plurality of radius extension elements are coupled to the standard raise boring head, the elements being arrayed circumferentially thereabout. Accordingly, tie rods are employed, to link each extension element to like extension elements adjacent thereto, principally to secure each element against displacement relative to the hub.

17 Claims, 2 Drawing Figures

CUTTER MOUNTING EXTENSION APPARATUS

This invention pertains to raise boring heads and in particular to apparatus for extending the effective cutting radius of raise boring heads in order that the same can ream or bore enlarged raises.

In raise boring operations it is frequently impossible to transport, through a subterranean tunnel or channel, a raise boring head of sufficient diameter to meet the boring or reaming requirements for a particular raise. Of course, it is neither prudent nor economical to enlarge such channels or tunnels, simply in order to be able to transport a sufficiently large raise boring head therethrough (to the location of a pilot bore where the head can be joined to the stem, to ream and form the raise). Rather, it is preferable to employ a smaller, standard, raise boring head, which is readily transportable through a constricted tunnel and, at the pilot bore site, extend the cutting radius of the head so that it will meet the raise boring requirements. Therefore, it is an object of this invention to set forth novel means for extending the cutting radius of a raise boring head. In particular it is an object of this invention to disclose, for use in combination with a raise boring head having a drive stem coupled to an earth cutter mounting platform, cutter mounting extension apparatus for extending the effective cutting radius of the raise boring head, comprising a raise boring head radius extension element; said extension element having means for replaceably mounting and supporting earth cutters thereon; means, having a radial center, for engaging a portion of a raise boring head drive stem; means for replaceably fastening said extension element to an earth cutter mounting platform of a raise boring head; and strut means replaceably fastening said extension element to said drive stem engaging means.

Figure 1:
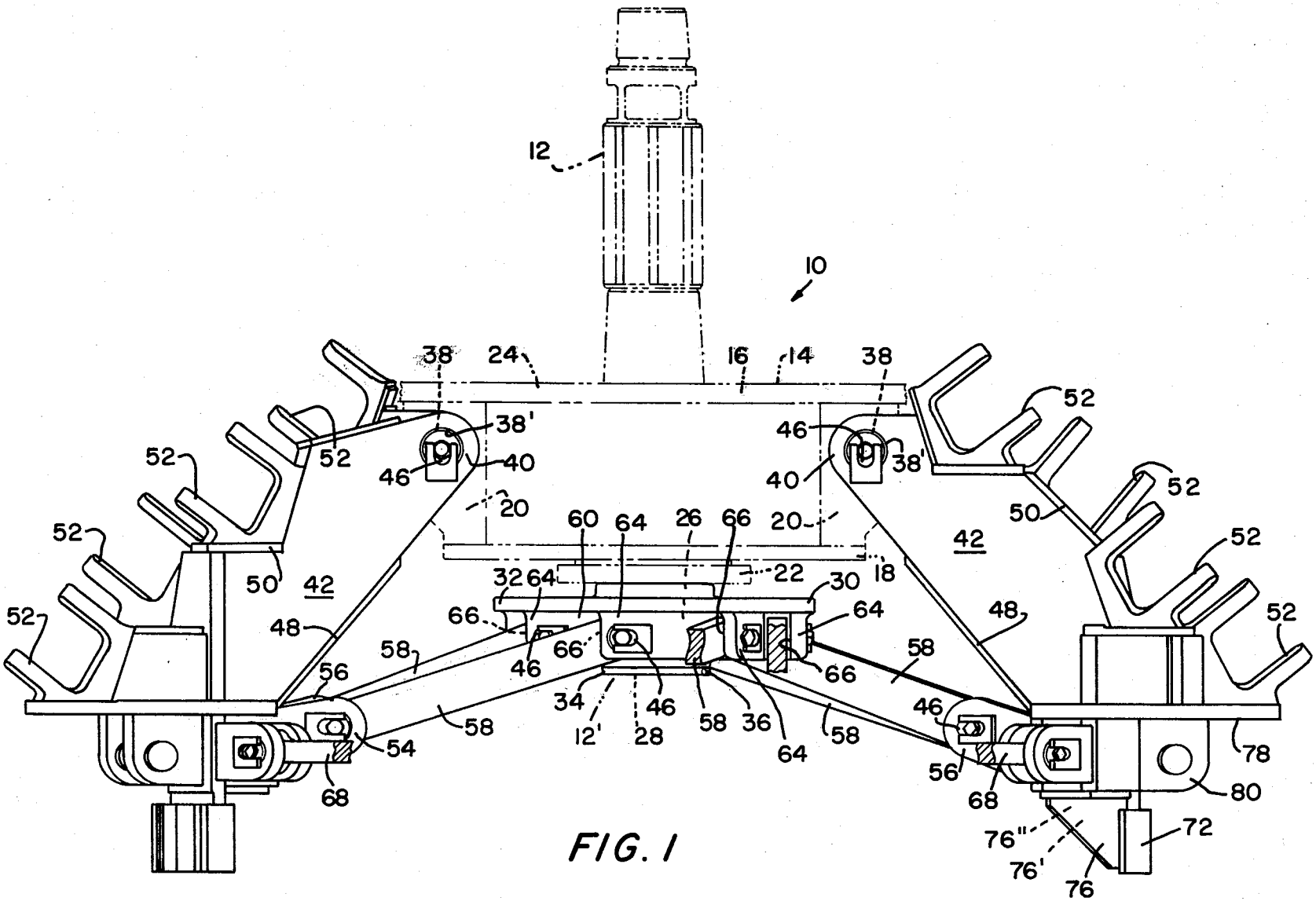
Figure 2:
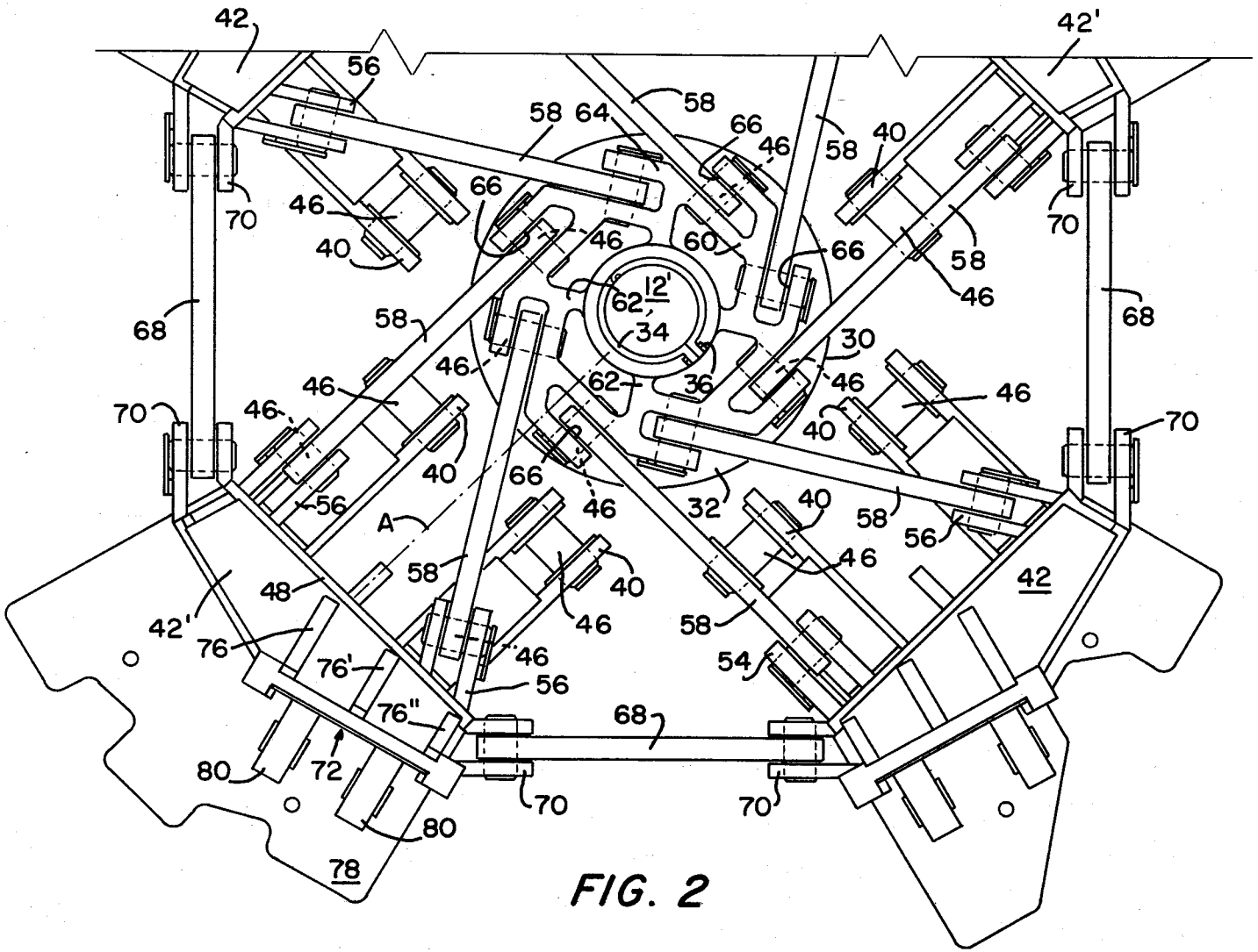

Further objects of this invention, as well as the novel features thereof, will become more apparent by reference to the following description taken in conjunction with the accompanying figures, in which:

FIG. 1 is a side, elevational view of a portion of an embodiment of the novel apparatus, the latter shown replaceably coupled to a standard raise boring head; and FIG. 2 is a bottom view of the embodiment of FIG. 1 where, however, the standard raise boring head has been omitted for purposes of clarity.

As depicted in the figures, a standard raise boring head 10 comprises a drive stem 12 and an earth cutter mounting platform 14. As is conventional, the platform is formed of a plate 16 joined to a lower plate 18 by strengthening weldments — ribs or weldments 20 being exemplary. A thrust plate 22, integral with the drive stem 12, cooperates to unitize the drive stem 12 with the built-up cutterhead 24 (defined by the plates and weldments).

A terminal, lower-most portion 12' of the drive stem 12 projects beyond plates 18 and 22. Portion 12' is externally splined, where and as indicated by index number 26; too, immediately adjacent the end of portion 12', an annular recess 28 is formed.

A hub-like structure 30, the same also having complementary internal splines, and having a circular plate 32 integral therewith, is mated with portion 12', and a split, clamping ring 34 is set into the recess 28 — and made fast with hardware 36 — to secure the structure 30 in mated positioning.

Cutterhead 24, in this depicted embodiment, carries eight (four-pairs) weldments 20, although only two (i.e., one weldment of two of the pairs) are shown. In this embodiment, the cutterhead 24 has two weldments 20 in parallel but spaced-apart disposition astride radial planes which are spaced apart by 90° of arc. Each weldment 20 has an aperture 38 formed therethrough in which to receive an expansion pin. The apertured weldments 20 define tongues which receive parallel, spaced-apart clevises 40 integrally formed with novel cutting radius extension elements 42 and 42'. The clevises too have apertures 38' formed therethrough for registry with apertures 38 — to receive the same expansion pins 46 — whereby the elements 42 are replaceably fastened, at one end, to the cutterhead 24.

Extension elements 42 and 42' comprise platforms having radially inner surfaces 48 and radially outer surfaces 50, the latter defining a base or deck which carries saddles 52 in which rolling earth cutters (or the like) are replaceably mountable. The nature of the cutter mountings, the saddles 52, is not germane to the instant invention. Yet, in the exemplary embodiment of this Extension Apparatus, it is proposed to employ cutter mountings of the type comprised by the disclosure in U.S. Pat. No. 3,836,271, "Shaft Mounting Means", issued 17 Sept. 1974, to William D. Coski.

In addition to the parallel, spaced-apart clevises 40 formed on one end of the extension elements 42 and 42', said elements have additional, non-parallel clevises 54 and 56 formed on, and extending generally radially inwardly from, the opposite ends thereof. It is particularly noted that clevises 54 and 56 extend generally radially inwardly; this is so, because clevis 54 extends truly perpendicular from inner surface 48, whereas clevis 56 extends diagonally, at a canted angle, therefrom.

Clevises 54 and 56, like clevises 40, are apertured to receive expansion pins 46 in order to fasten thereto the radially outer ends of elongate struts 58. Means provided therefor, and carried beneath plate 32 of structure 30, receive the radially inner ends of struts 58.

Beneath, and integral with, plate 32 is a spiderlike structure 60 formed of radial ribs 62 mutually joined to bosses 64 having U-shaped recesses 66 formed therein. The open ends of the recesses 66 are tangentially directed (relative to circular plate 32); here too, the bosses 64 are apertured — transverse of the recesses 66 — that the radially inner ends of the struts 58 can be fastened thereto by further expansion pins 46.

Each radius extension element 42 or 42' is linked to the drive stem-receiving structure 30 by a pair of the struts 58. In that the recesses 66 are tangentially arranged, and the clevises 56 are diagonally canted, each element 42 or 42' has a strut 58 so disposed as to react the torsional forces which are impressed on the element (42 or 42') during rotation of the cutterhead 24. This can be appreciated on noting the arrow in FIG. 2. The cutterhead 24, with the cutting radius extending elements coupled thereto, rotates in a normal clockwise direction; FIG. 2 being a bottom view, the same indicates the "from below" rotary direction of the machine or apparatus as obtains during earth boring operation. The torsionalforce reacting arrangement is so designed, in this novel configuration, that a radial plane "A" drawn perpendicularly from a mid-point of a surface 48, which bisects the stem portion 12', finds both inner ends of an element's struts 58 fixed (to structure 60) to one common side of the plane "A". Also, of course, the struts 58, in cooperation with means tying each of the elements 42 and 42' together circumferentially, react the thrust forces which are addressed to the elements (42, 42'). This is especially accomplished by fixing the struts 58, in accord with our invention, to the structure 60 in a one-sided over-reach.

As for the circumferential tying-together of the elements 42 and 42', this is provided by tie bars 68. In the embodiment shown, the Extension Apparatus comprises a plurality of the novel radius extension elements: a pair of opposed elements 42, and a pair of opposed elements 42'. Accordingly, four tie bars 68 are employed to bridge between and unitize these elements.

Each of the elements 42 and 42' has a pair of clevises 70, one of each at opposite ends of the elements extending therefrom and angulated at 45° of arc from the plane of surface 48. Clevises 70 are bored through, and so also are the ends of the tie bars 68, to receive expansion pins 46 thereat. Thus, each element 42 or 42' is securely trussed, by the several supports afforded by the tie bars 68, the struts 58 and the fastening of the clevises 40 to the weldments 20. Yet, the overall assembly is simple to accomplish, simple and facile of disassembly and servicing, the hardware (i.e., expansion pins 46) is sturdy, reliable, and easily removable, the struts 58 are each of uniform length and configuration, and the tie bars 68 are each of uniform length and configuration and are positionally interchangeable and capable of substitution for each other, i.e., strut for strut, and tie bars for tie bars. So too, an extension 42 is interchangeable with the other extension 42 and the same is true of extensions 42'. The assembly of circumferentially-arrayed radius extension elements 42 and 42' which, as FIG. 1 makes self-evident, increases the cutting radius by approximately one hundred percent, is made possible by a kit of components. Such a kit comprises only the structure 30, four radius extension elements, eight struts, four tie bars, one clamping ring 34, and hardware.

Where it is desired to further increase the cutting radius — beyond that evident in FIGS. 1 and 2 — our invention comprises provisioning therefore as well. Each radius extension element 42 and 42' carries pendantly therefrom a buttressed component which defines a bearing surface 72. The latter is firmly secured in vertical pendancy by buttressing triangular weldments or plates 76 (and 76' and 76''). Fixed to the underlying surface 78, of element 42 (or 42'), is a clevis 80, bored through to accept fastening hardware, in which a tongue or lug of a further radius extension element can be secured. By this provisioning, then, such a further or second radius extension element can be abutted against surface 72, and fixed by means of clevis 80 and an associated expansion pin 46.

While we have described our invention in connection with a specific embodiment thereof, it is to be clearly understood that this is done only by way of example and not as a limitation to the scope of our invention as set forth in the objects thereof and in the appended claims.

We claim:

1. For use in combination with a raise boring head having a drive stem coupled to an earth cutter mounting platform, cutter mounting extension apparatus for extending the effective cutting radius of the raise boring head, comprising:

a raise boring head radius extension element;

said extension element having means for replaceably mounting and supporting earth cutters thereon;

means, having a radial center, for immovably engaging a portion of said raise boring head drive stem;

means for replaceably fastening said extension element to said earth cutter mounting platform of said raise boring head; and strut means replaceably fastening said extension element immovably to said drive stem engaging means.

2. Apparatus according to claim 1, wherein:

said drive stem engaging means comprises an annular structure;

said strut means comprises a plurality of struts, each coupled at one end thereof to said annular structure, and coupled at the opposite end thereof to said extension element; wherein one of said struts of said plurality thereof extends perpendicularly from said extension element, and another of said struts extends diagonally from said extension element.

3. Apparatus, according to claim 2, wherein:

said one ends of said one and another struts are coupled to said annular structure in a relatively near adjacency to each other; and said opposite ends of said one and another struts are coupled to said extension element in a relatively spaced-apart disposition defining, therebetween, and lengthwise of said struts, a converging/diverging relationship.

4. Apparatus, according to claim 3, wherein:

said annular structure has means integral therewith for replaceably coupling thereto said one ends of said struts of said plurality thereof;

said coupling means comprises a plurality of mounting bosses;

said bosses having generally U-shaped recesses formed therein in which to receive said one ends of said struts; and said recesses have their U-shaped open ends directed tangentially of said annular structure.

5. Apparatus, according to claim 1, wherein:

said drive stem engaging means comprises a hub;

said hub, having a central bore within which couplingly to receive said drive stem, said hub further having a circumferential, circular plate joined thereto;

said strut means comprises a plurality of struts, each coupled at one end thereof to said plate, and coupled at the opposite end thereof to said extension element; and said struts extend from said plate tangentially thereto.

6. Apparatus, according to claim 5, wherein:

all struts of said plurality thereof are of common length and, whereat said struts are coupled to said extension element and said plate, have common mounting distances between said one and opposite ends thereof; and said opposite ends of said struts are substantially a common distance from said plate, whereas said one ends of said struts are at markedly diverse distances from said extension element.

7. Apparatus, according to claim 1, wherein:

said extension element comprises a body having opposite terminal sides;

one of said sides, having a given length, defines a radially innermost side thereof and the other of said sides define a radially outermost side thereof;

a plane drawn perpendicular to said one side of said body, from a mid-point along the length thereof, bisects said radial center of said drive stem engaging means; and said strut means is fastened to said drive stem engaging means only to one side of said plane.

8. Apparatus, according to claim 7, further including:

means replaceably coupled to said body, at opposite ends thereof, tying said body securely against displacement thereof relative to said drive stem engaging means.

9. Apparatus, according to claim 7, wherein:

said tying means comprises a plurality of raise boring head radius extension elements, means coupling said plurality of extension elements to said drive stem engaging means, and tie bars; and each of said tie bars is coupled at one end thereof to said body and at the end opposite thereof to an extension element of said plurality thereof.

10. Apparatus, according to claim 1, wherein:

said extension element comprises a body;

said body having means for replaceably attaching thereto a second raise boring head radius extension element; and said attaching means comprises means defining a bearing surface for receiving a second extension element in abutting relationship therewith, and means for replaceably fastening a second extension element thereto.

11. Apparatus, according to claim 10, wherein:

said bearing surface has a portion which extends pendantly from said body.

12. Apparatus, according to claim 1, wherein:

said strut means comprises means for reacting torsional forces impressed on said radius extension element.

13. Apparatus, according to claim 1, wherein:

said strut means comprises means for reacting thrust forces impressed on said radius extension element.

14. In combination with a rotatable raise boring head having an axial drive stem and an earth cutter mounting platform coupled thereto, cutter mounting extension apparatus extending the effective cutting radius of the raise boring head, comprising:

a raise boring head radius extension body;

said body having means for replaceably mounting and supporting earth cutters thereon;

means engaging a portion of said drive stem for rotation in common therewith; and means replaceably fastening said body to said boring head; wherein said fastening means comprises a plurality of elongate struts each coupled at one end thereof to said body and coupled at the opposite end thereof to said boring head;

one of said struts of said plurality thereof extends perpendicularly from said body; and another of said struts extends diagonally from said body.

15. The combination, according to claim 14, wherein:

said body has a radially innermost side, said side having a given length;

a plane drawn perpendicularly from said side, from the mid-point thereof along the length thereof, bisects said drive stem;

said one ends of said struts are coupled to said body on opposite sides of said plane; and said opposite ends of said struts are coupled to said body on only one side of said plane.

16. The combination, according to claim 15, further including:

means replaceably coupled to said body, at opposite ends thereof, tying said body securely against displacement thereof relative to said drive stem; wherein said tying means comprises a plurality of raise boring head radius extension bodies, means coupling said plurality of bodies to said raise boring head, and tie bars; and each of said tie bars is coupled at one end thereof to said body and at the other end thereof to one of said bodies of said plurality thereof.

17. The combination, according to claim 14, further including:

means replaceably coupled to said body tying said body securely against displacement thereof relative to said drive stem.

* * * * *